US007814592B1

(12) United States Patent
Schenck

(10) Patent No.: US 7,814,592 B1
(45) Date of Patent: Oct. 19, 2010

(54) BACKBOARD WITH IMPROVED STIFFNESS CHARACTERISTICS

(75) Inventor: David Schenck, Erie, PA (US)

(73) Assignee: Trauma Technologies, Inc., Lake City, PA (US)

( * ) Notice: Subject to any disclaimer, the term of this patent is extended or adjusted under 35 U.S.C. 154(b) by 0 days.

(21) Appl. No.: 12/384,234

(22) Filed: Apr. 1, 2009

(51) Int. Cl.
*A61G 1/00* (2006.01)

(52) U.S. Cl. ..... 5/625; 5/626; 5/951

(58) Field of Classification Search ..... 5/625–629, 5/951; 128/869, 870
See application file for complete search history.

(56) References Cited

U.S. PATENT DOCUMENTS 5,950,627 A * 9/1999 Bologovsky et al. ..... 128/869
6,668,397 B2 * 12/2003 Olenick et al. ..... 5/118
6,711,762 B2 * 3/2004 Olenick et al. ..... 5/118
6,915,805 B2 * 7/2005 Crutchfield ..... 128/870
7,028,357 B2 * 4/2006 Holland ..... 5/626
2003/0140415 A1 * 7/2003 Olenick et al. ..... 5/118
2003/0140416 A1 * 7/2003 Olenick et al. ..... 5/118
2003/0200972 A1 * 10/2003 Crutchfield ..... 128/845
2004/0187214 A1 * 9/2004 Holland ..... 5/626

* cited by examiner

*Primary Examiner*—Robert G Santos
(74) *Attorney, Agent, or Firm*—Richard K Thomson

(57) ABSTRACT

A medical backboard for carrying patients is reinforced with 1" bamboo poles extending substantially the length of the board's body on either side adjacent the handles. This board showed greater stiffness and flexibility than similar boards reinforced with carbon fiber rods.

4 Claims, 3 Drawing Sheets

AD#-306

TABLE I

Deflection

| Board# | 1 | 2 | 3 | 4 | 5 | 6 | 7 | 8 |
|---|---|---|---|---|---|---|---|---|
| Load | | | | | | | | |
| 35-40# | .633" | .25" | | | | | | |
| 70-75 | 1.0" | .625" | | | | | | |
| 100-110 | 2" | 1.25" | .625" | .75" | .5" | 1" | 1" | |
| 140-150 | 2.5" | 1.75" | | | | | | |
| 175-180 | 3.0" | 2.25" | | | | | | 1" |
| 210-220 | 3.88" | 2.375" | 1.5" | 2" | | 2" | 2" | |
| 240-250 | 4.375" | 3.5" | | | | | | |
| 280-290 | 5.375" | 3.675" | | | | | | |
| 310-320 | 7.75" | 4.0" | | | | | | |
| 350-360 | | 4.375" | | 2" | | | | |
| 380-390 | | 4.75" | | | | | | 2" |
| 420-430 | | 5.25" | | | | | | |
| 430-440 | | | 2" | | | | | |
| 450-460 | | | | 2.5" | 2" | | | |
| 540-550 | | | | | | 5" | 3" | |
| 590-600 | | | | 3" | | | | |
| 630-660 | | | | | | F | | 3.675" |
| 660-670 | | | 3.5" | | | | 5.5" | |
| 670-680 | | | | | 2.5" | | | |
| 720-740 | | | | | | | 6.5" | |
| 760-770 | | | | | | | | F |
| 770-780 | | | | 3.75" | | | | |
| 820-850 | | | | 4.5" | 2.75" | | 8" | |
| 1030+ | | | 5.5" | 1+" | 3" | | | |

Board

1 HDPE board

2 HDPE board with 1" wooden dowels 3 11# MDPE with 1" bamboo reinforcing rods 4 12.5# MDPE board with 1" bamboo reinforcing rods 5 14.5# HDPE board with foam 6 13.5# HDPE board with foamed in place 1" bamboo rods 7 11# HDPE with foam (total wt 12.85#)

8 HDPE with 1" carbon fiber pultruded rod

Fig. 5

BACKBOARD WITH IMPROVED STIFFNESS CHARACTERISTICS

BACKGROUND AND SUMMARY OF THE INVENTION

The present invention is directed to the field of medical supplies. More particularly, the present invention is directed to a backboard for transporting patients which has improved stiffness and flexibility.

The backboard of the present invention embeds 1" diameter bamboo poles in high density polyethylene hollow board that is then filled with rigidifying foam. Unexpectedly, the reinforced backboard of the present invention achieved strength capabilities equivalent of boards reinforced with carbon fiber without the expense and risk of catastrophic failure associated with the more brittle, higher tensile strength carbon fiber rods.

The present invention is directed to a backboard for transporting medical patients, the backboard comprising a) an elongated substantially rectangular body portion having a width and a length; b) integral handles molded around a periphery of the body portion; c) a plurality of bamboo stiffening elements running substantially the length of the backboard, the plurality of bamboo stiffening elements reducing an amount of deflection of the backboard when placed under load. The plurality of bamboo stiffening elements comprises two bamboo poles having a diameter of 1" positioned adjacent the integral handles along each lateral edge of the body portion. The substantially rectangular body portion is preferably molded from high density polyethylene (HDPE) having a hollow interior that is filled with a rigid foam.

The invention further comprises a method of making a backboard for transporting medical patients, the method comprising the steps of a) molding a substantially rectangular hollow body portion from high density polyethylene (HDPE); b) drilling a plurality of holes in an end portion of the hollow body portion; c) inserting an elongated bamboo stiffening element in each of the plurality of holes; d) filling the hollow body portion not occupied by the plurality of elongated stiffening elements with rigidifying foam. Preferably, the method further comprises plugging each of the plurality of holes prior to the filling step and drilling an additional hole in the hollow body portion in an alternate location for accomplishing the filling step.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which

FIG. 5 is a table displaying comparative data.

DETAILED DESCRIPTION OF THE PREFERRED EMBODIMENT(S)

Figure 1:
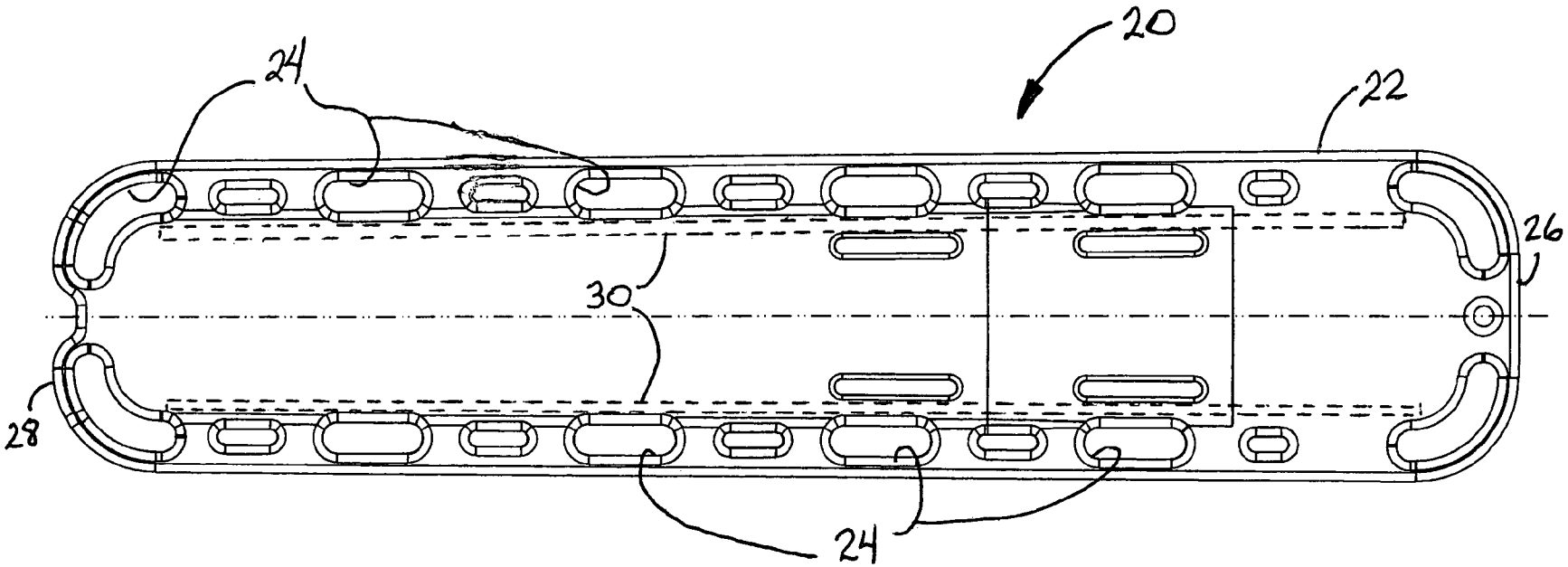
FIG. 1 is a top perspective view of a first embodiment of the backboard of the present invention.
Figure 2:
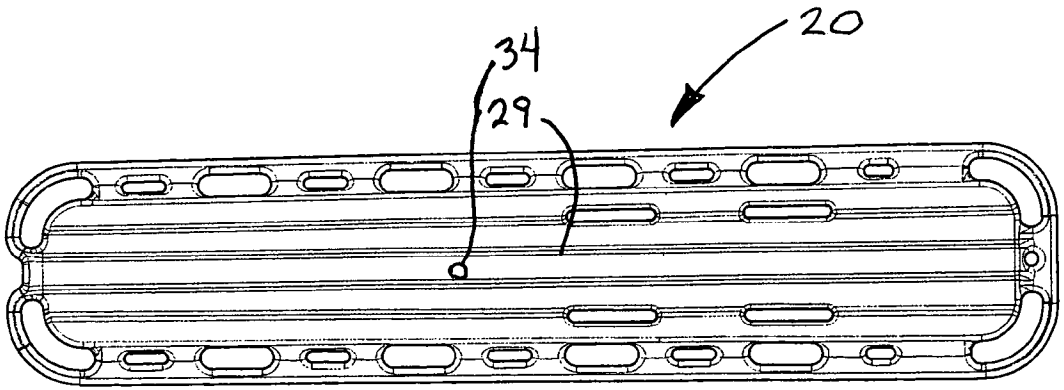
FIG. 2 is a bottom perspective view of the first embodiment.
Figure 3:
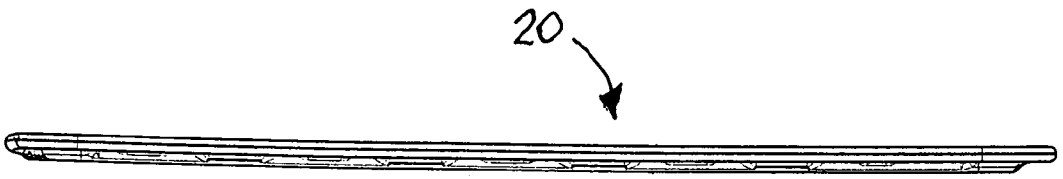
FIG. 3 is a side view of the first embodiment.
Figure 4:
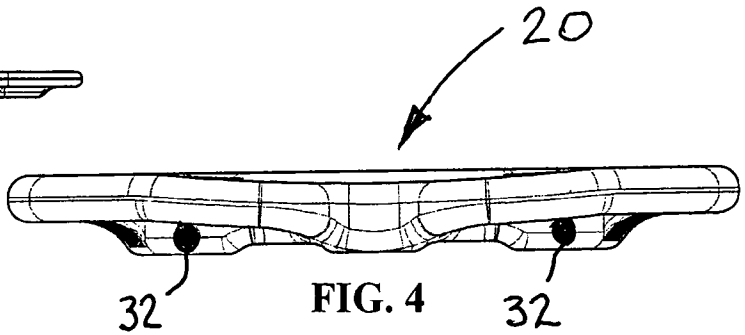
FIG. 4 is an end view of the first embodiment.

A first embodiment of the reinforced medical backboard of the present invention is depicted in FIGS. 1-4 generally at 20.

Backboard 20 is configured as an elongated, substantially rectangular body portion 22 with integral handles 24 molded into the body portion 22 around the periphery of the board 20. The body portion 22 is characterized as being substantially rectangular given that there is a slight taper from head end 26 to foot end 28.

What makes this medical backboard 20 unique is the inclusion of bamboo reinforcing poles 30 running substantially the entire length of the body portion 22. Backboard 20 is preferably molded of high density polyethylene (HDPE) using centrifugal molding techniques to form a hollow body portion 22. Then two entry holes are drilled in the body portion 22 near the head end 26 (FIG. 4) and 1" bamboo poles are inserted into hollow body portion 22. Once the bamboo poles 30 are in place, the entry holes are closed by installing plugs 32 to secure the poles 30 within the backboard 20. Then, an auxiliary hole 34 is drilled in the bottom 29 of board 20 and the hollow interior of body portion 22 is filled with a rigidifying foam. A suitable material is a two component system available from Foam Supplies, Inc., 4387 North Rider Trail, Earth City, Mo. 63045, under the registered trademark ECOMATE. Hole 34 is then plugged to complete the assembly.

Tests were run to determine the comparative advantages of reinforcing medical backboards with bamboo vs other possible materials. FIG. 5 depicts these comparative tests. Boards were suspended between sawhorses 5" from each end as additional weight was applied. Measurements were taken at the center of the board to determine maximum deflection under load. Board #1 was a non-reinforced HDPE board; board #2 was an HDPE board reinforced with wooden dowels. Board #3 was made of medium density polyethylene (MDPE), total board weight of 11 pounds, with 1" diameter bamboo inserts. Board #4 was made of 14.5# HDPE; board #5 with 13.5# HDPE with bamboo inserts; board #6 was made of 13.5# HDPE with injected rigidifying foam. This board failed at loading of 660#. Board #7 was manufactured from 11.5# HDPE with 1.85# of rigidifying foam injected; and, board #9 was reinforced with 1" diameter carbon fiber pultruded rods. This board cracked and collapsed under 762#. As can be seen the boards having bamboo reinforcing poles (boards #3, 6) outperformed all other tested configurations, even accepting more weight and having less deflection than board #8 reinforced with 1" carbon fiber pultruded rods. Industry prefers the HDPE boards to the MDPE due to the lighter weight required to achieve the desired stiffness and strength.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A backboard for transporting medical patients, said backboard comprising a) an elongated substantially rectangular body portion having a width, a length, a substantially planar upper surface and a substantially planar lower surface, wherein said substantially rectangular body portion is made of high density polyethylene (HDPE), said substantially rectangular body portion being hollow and filled with a rigidifying foam;

b) integral handles molded around a periphery of said body portion;

c) a pair of bamboo stiffening elements running substantially said length of said backboard positioned adjacent said integral handles along each lateral edge of said body portion and between said upper and lower surfaces, said pair of bamboo stiffening elements being spaced by more than half said width of said rectangular body portion and reducing an amount of deflection of said backboard when placed under load;

whereby said rigidifying foam embeds said pair of bamboo stiffening elements and said backboard has improved strength, stiffness and flexibility as compared to backboards reinforced with carbon fibers.

2. A method of making the backboard of claim 1, said method comprising the steps of a) molding a substantially rectangular hollow body portion of high density polyethylene (HDPE);

b) drilling a plurality of holes in an end portion of said hollow body portion;

c) inserting an elongated bamboo stiffening element in each of said plurality of holes;

d) filling said hollow body portion not occupied by said plurality of elongated stiffening elements with a rigidifying foam.

3. The method of claim 2 further comprising plugging each of said plurality of holes prior to said filling step and drilling an additional hole in said hollow body portion in an alternate location for accomplishing said filling step.

4. The method of claim 3 further comprising the step of plugging said additional hole which is used for the filling step.

* * * * *